US011111802B2

(12) United States Patent
Propheter-Hinckley et al.

(10) Patent No.: US 11,111,802 B2
(45) Date of Patent: Sep. 7, 2021

(54) SEAL FOR A GAS TURBINE ENGINE

(71) Applicant: United Technologies Corporation, Farmington, CT (US)

(72) Inventors: Tracy A. Propheter-Hinckley, Rocky Hill, CT (US); Egon Salimusaj, East Hartford, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 111 days.

(21) Appl. No.: 16/400,618

(22) Filed: May 1, 2019

(65) Prior Publication Data

US 2020/0347738 A1 Nov. 5, 2020

(51) Int. Cl.
*F01D 11/00* (2006.01)

(52) U.S. Cl.
CPC ..... *F01D 11/001* (2013.01); *F05D 2230/10* (2013.01); *F05D 2230/60* (2013.01)

(58) Field of Classification Search
CPC . F01D 11/001; F05D 2230/10; F05D 2230/60
USPC ..... 415/173.3
See application file for complete search history.

(56) References Cited

U.S. PATENT DOCUMENTS 4,524,980 A * 6/1985 Lillibridge ..... F01D 11/008 277/641
4,767,260 A * 8/1988 Clevenger ..... F01D 9/041 415/115
5,154,577 A * 10/1992 Kellock ..... F01D 11/005 277/641
5,709,530 A * 1/1998 Cahill ..... F01D 11/005 277/644
5,971,703 A 10/1999 Bouchard
6,241,467 B1 * 6/2001 Zelesky ..... F01D 9/04 415/115
6,254,333 B1 * 7/2001 Merry ..... F01D 11/005 415/115
6,412,268 B1 * 7/2002 Cromer ..... F01D 9/023 60/760
6,773,229 B1 * 8/2004 Itzel ..... F01D 9/041 415/191
7,201,559 B2 * 4/2007 Gendraud ..... F01D 11/005 277/641

(Continued)

FOREIGN PATENT DOCUMENTS

WO WO-2008046684 A1 * 4/2008 ..... F01D 11/006
WO WO-2014117998 A1 * 8/2014 ..... F01D 11/008

(Continued)

OTHER PUBLICATIONS

Extended EP Search Report for EP Application No. 20168955.1 dated Jun. 30, 2020.

*Primary Examiner* — J. Todd Newton
(74) *Attorney, Agent, or Firm* — Carlson, Gaskey & Olds, P.C.

(57) ABSTRACT

A component for a gas turbine engine includes a first platform that has a first pair of circumferential surfaces and a first axially aft surface. A first axially extending seal slot is located in each of the first pair of circumferential surfaces and the first axially aft surface. A first cover plate is attached to the first axially aft surface and encloses at least a portion of the first axially extending seal slots.

19 Claims, 4 Drawing Sheets

(56) References Cited

U.S. PATENT DOCUMENTS 7,600,967 B2 * 10/2009 Pezzetti, Jr. ..... F01D 11/005 415/115
7,798,769 B2 * 9/2010 Keller ..... F01D 11/006 415/135
8,096,758 B2 * 1/2012 Schiavo ..... F01D 5/147 415/200
8,105,041 B2 * 1/2012 Brillert ..... F01D 5/3015 416/221
8,308,428 B2 * 11/2012 Bridges, Jr. ..... F01D 9/041 415/139
8,534,995 B2 * 9/2013 McCaffrey ..... F01D 5/225 415/173.1
8,727,710 B2 * 5/2014 Propheter-Hinckley ..... F01D 11/005 415/139
10,196,913 B1 * 2/2019 Boeke ..... F01D 9/041
2005/0008473 A1 * 1/2005 Balsdon ..... F01D 11/008 415/110
2008/0181767 A1 * 7/2008 Brillert ..... F01D 5/081 415/170.1
2009/0016873 A1 * 1/2009 Bridges, Jr. ..... F01D 9/041 415/139
2011/0014050 A1 * 1/2011 Lake ..... F16J 15/0887 416/204 A
2012/0219405 A1 * 8/2012 Szwedowicz ..... F16J 15/0887 415/173.3
2015/0064012 A1 * 3/2015 Heaven ..... F01D 5/30 416/219 R
2016/0003079 A1 * 1/2016 Boeke ..... F01D 11/005 415/1
2019/0162073 A1 * 5/2019 Tyagi ..... F01D 11/008

FOREIGN PATENT DOCUMENTS

WO 2014138320 9/2014
WO WO-2014138320 A1 * 9/2014 ..... F01D 9/041
WO WO-2014146827 A1 * 9/2014 ..... B23H 9/10
WO WO-2015086240 A1 * 6/2015 ..... F01D 11/006

* cited by examiner

SEAL FOR A GAS TURBINE ENGINE

BACKGROUND

A gas turbine engine typically includes a fan section, a compressor section, a combustor section, and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section.

Feather seals are commonly utilized in aerospace and other industries to provide a seal between two adjacent components. For example, gas turbine engine vanes are arranged in a circumferential configuration to form an annular vane ring structure about a center axis of the engine. Typically, each stator segment includes an airfoil and a platform section. When assembled, the platforms abut and define a radially inner and radially outer boundary to receive hot gas core airflow.

Typically, the edge of each platform includes a channel which receives a feather seal assembly that seals the hot gas core airflow from a surrounding medium such as a cooling airflow. Feather seals are often typical of the first stage of a high pressure turbine in a twin spool engine.

Feather seals may also be an assembly of seals joined together through a welded tab and slot geometry which may be relatively expensive and complicated to manufacture.

SUMMARY

In one exemplary embodiment, a component for a gas turbine engine includes a first platform that has a first pair of circumferential surfaces and a first axially aft surface. A first axially extending seal slot is located in each of the first pair of circumferential surfaces and the first axially aft surface. A first cover plate is attached to the first axially aft surface and encloses at least a portion of the first axially extending seal slots.

In a further embodiment of the above, the first axially aft surface intersects the pair of circumferential surfaces.

In a further embodiment of any of the above, the first axially extending seal slots are formed with a grinding process.

In a further embodiment of any of the above, the first cover plate is welded to the first axially aft surface.

In a further embodiment of any of the above, the first axially extending seal slots extend through a leading edge of the first platform.

In a further embodiment of any of the above, a portion of the first axially aft surface defines a trailing edge rail. The axially aft surface intersects the pair of circumferential surfaces and the component includes one of a blade outer air seal or an airfoil.

In a further embodiment of any of the above, the component is an airfoil and includes an airfoil that has a first end adjacent the first platform. A second end is adjacent a second platform and has a second pair of circumferential surfaces and a second axially aft surface. A second axially extending seal slot is located in each of the second pair of circumferential surfaces and the second axially aft surface.

In a further embodiment of any of the above, a second cover plate is attached to the second axially aft surface and encloses at least a portion of the second axially extending seal slots.

In another exemplary embodiment, a gas turbine engine includes a compressor section upstream of a combustor section. A turbine section is downstream of the combustor section. At least one of the compressor section or the turbine section includes a component that has a first platform that has a first pair of circumferential surfaces and a first axially aft surface. A first axially extending seal slot is located in each of the first pair of circumferential surfaces and the first axially aft surface. A first cover plate is attached to the first axially aft surface and encloses at least a portion of the first axially extending seal slots.

In a further embodiment of any of the above, the first axially aft surface intersects the pair of circumferential surfaces.

In a further embodiment of any of the above, the first axially extending seal slots are formed with a grinding process.

In a further embodiment of any of the above, the first cover plate is welded to the axially aft surface.

In a further embodiment of any of the above, the first axially extending seal slot extends through a leading edge of the first platform.

In a further embodiment of any of the above, the component is an airfoil and includes an airfoil that has a first end adjacent the first platform. A second end is adjacent a second platform that has a second pair of circumferential surfaces and a second axially aft surface. A second axially extending seal slot is located in each of the second pair of circumferential surfaces and the second axially aft surface.

In a further embodiment of any of the above, a second cover plate is attached to the second axially aft surface and encloses at least a portion of the second axially extending seal slots.

In another exemplary embodiment, a method of forming a seal slot in a component includes the step of forming a first axially extending seal slot through each of a pair of first circumferential surfaces and a first axially aft surface on a first platform. A portion of the first axially extending seal slot is enclosed with a cover plate attached to the first axially aft surface.

In a further embodiment of any of the above, the first axially extending seal slot is formed through a grinding process.

In a further embodiment of any of the above, the method includes the step of forming a second axially extending seal slot through each of a pair of second circumferential surfaces and a second axially aft surface of a second platform opposite the first platform. At least a portion of the pair of second axially extending seal slot is enclosed with a second cover plate attached to the second axially aft surface.

In a further embodiment of any of the above, the second axially extending seal slot is formed through a grinding process.

In a further embodiment of any of the above, the second cover plate is welded to the first axially aft surface.

DETAILED DESCRIPTION

Figure 1:
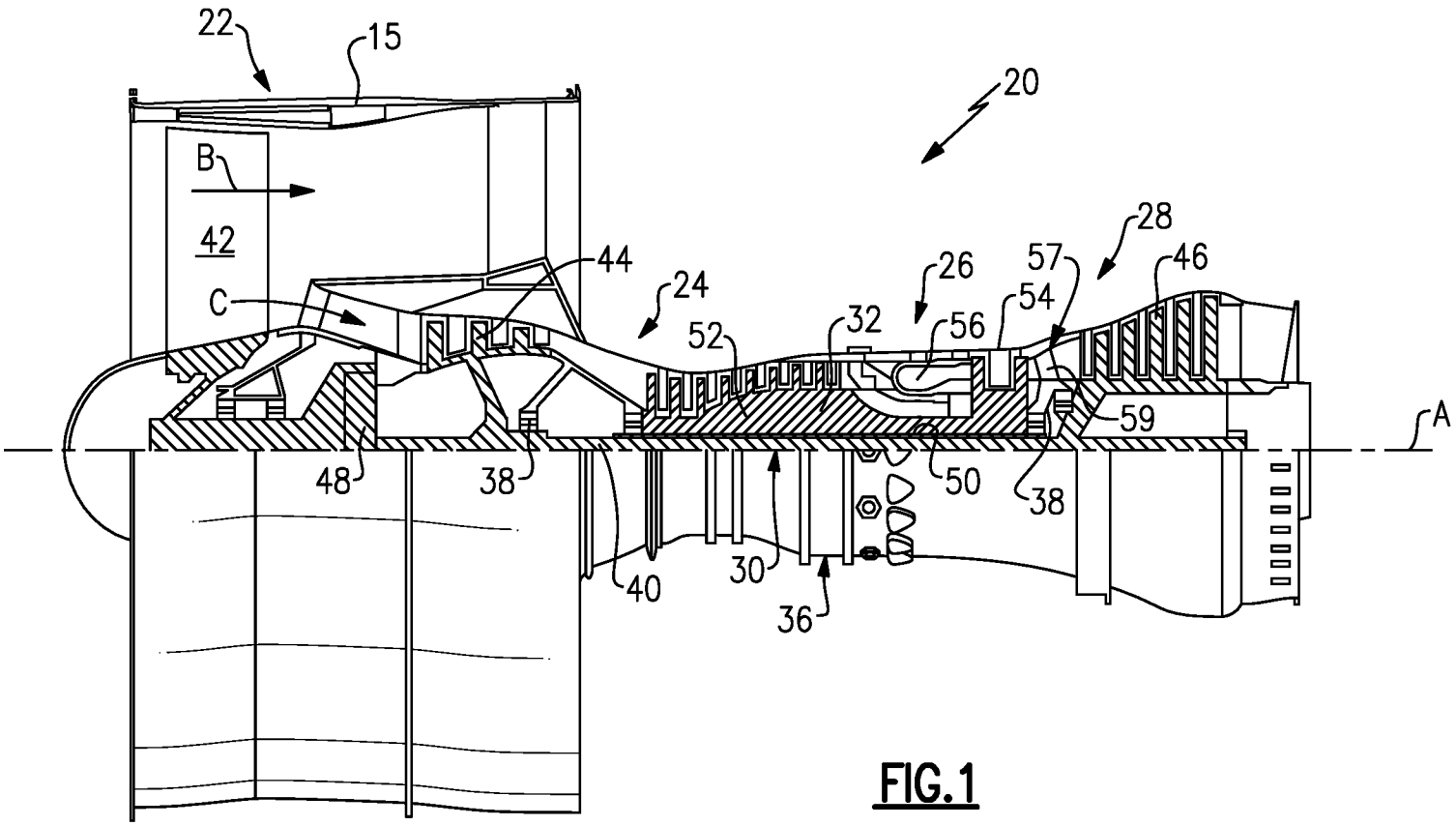
FIG. 1 is a schematic view of a gas turbine engine according to a first non-limiting example.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct defined within a nacelle 15, and also drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive a fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 may be arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of the low pressure compressor, or aft of the combustor section 26 or even aft of turbine section 28, and fan 42 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1 and less than about 5:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC)"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second (350.5 meters/second).

Figure 2:
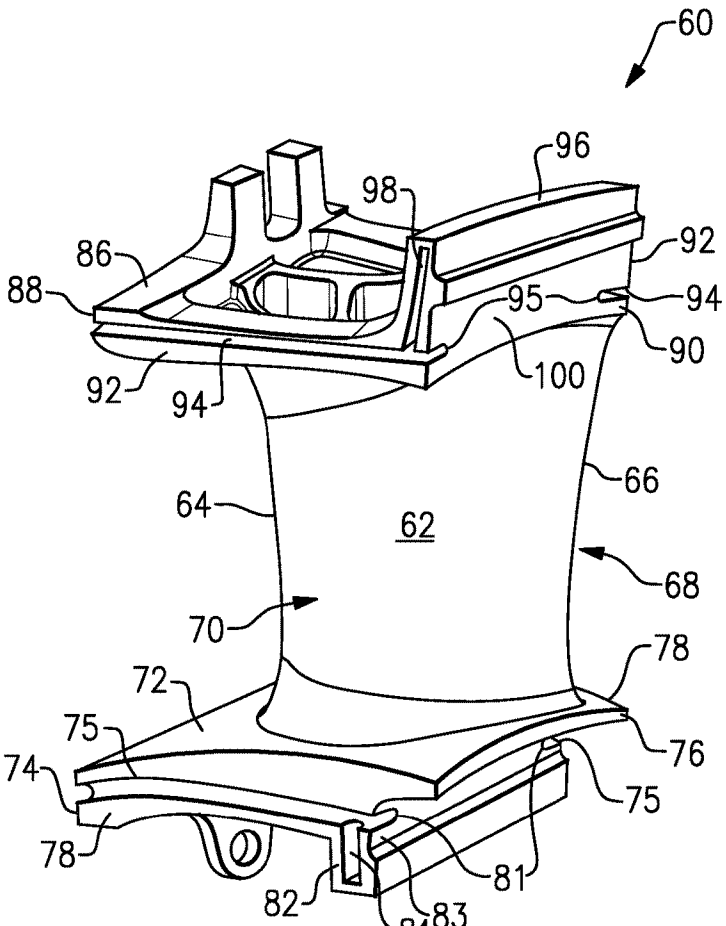
FIG. 2 illustrates a perspective view of an example vane.

FIG. 2 illustrates an example vane 60. The vane 60 includes an airfoil 62 extending axially between a leading edge 64 and a trailing edge 66. The leading edge 64 and the trailing edge 66 also separate a pressure side 68 from a suction side 70 on the airfoil 62.

The airfoil 62 extends radially outward from an inner platform 72 to an outer platform 86. The inner platform 72 includes a leading edge 74 and a trailing edge 76 that extend between circumferential side surfaces 78. An axially extending feather seal slot 75 extends through each of the circumferential side surfaces 78. The inner platform 72 also includes an inner rail 82 extending inward from an axially aft portion of the inner platform 72. The inner rail 82 also includes an inner rail feather seal slot 84 that extends in a radial direction. In this disclosure, axial or axially and radial or radially is with respect to the engine axis A unless stated otherwise.

The radially outer platform 86 includes a leading edge 88 and a trailing edge 90 that extend between opposite circumferential side surfaces 92. The outer platform 86 also includes an axially extending feather seal slot 94 in each of the circumferential side surfaces 92. In the illustrated example, the feather seal slot 94 is formed through a grinding process. The grinding process used to form the feather seal slot 94 produces a smoother surface finish which increases contact area with a feather seal 104 (FIG. 4) to reduce air loss between adjacent vanes 60. The grinding process creates a surface roughness of between 10 and 125

RA. Additionally, because the feather seal slot 94 is formed with a grinding process, the feather seal slot 94 is linear.

The surface roughness resulting from the grinding process is an improvement over a traditional process that utilizes EDM to form the feather seal slot 94. The surface roughness formed from EDM is approximately 250 RA. Additionally, because a grinding process is used to form the feather seal slot 94, an end gap 95 is formed in an axially aft surface 100 of the outer platform 86. The axially aft surface 100 extends circumferentially along the outer platform 86 and an outer rail 96. The outer rail 96 also includes an outer rail feather seal slot 98 that extends in a radial direction. The outer rail feather seal slot 98 is formed from an EDM process. Therefore, a surface roughness of the feather seal slot 94 has a different surface roughness than the outer rail feather seal slot 98. As shown in FIG. 2, each of the circumferential side surfaces 92 include the feather seal slot 94 that is formed with the grinding process. Additionally, the leading edge 88 of the outer platform 86 also includes an opening corresponding to the feather seal slots 94 in each of the opposing circumferential side surfaces 92.

Figure 3:
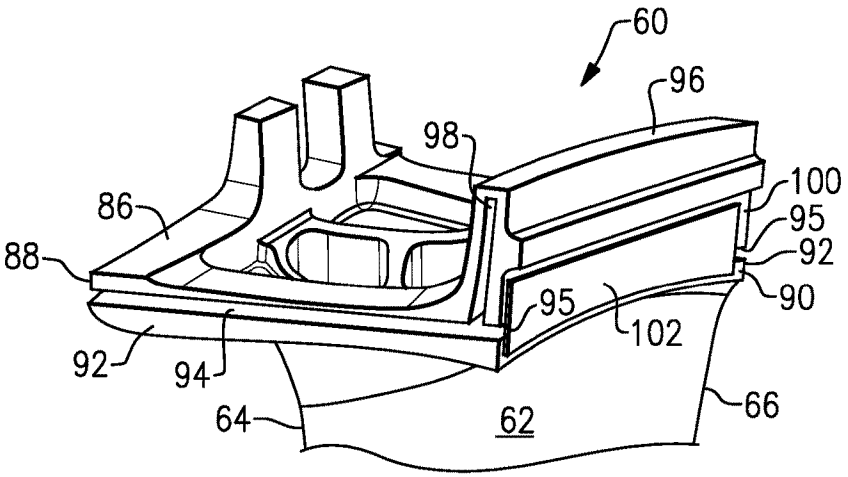
FIG. 3 illustrates an enlarged view of a radially outer platform of the van of FIG. 2 with a cover plate.

As shown in FIG. 3, the end gaps 95 are at least partially enclosed by a cover plate 102. In the illustrated example, the cover plate 102 extends a substantial width of the axially aft surface 100 and is attached to the axially aft surface 100 by a laser welding process. In the illustrated example, the cover plate 102 extends to adjacent the circumferential side surfaces 92. Although the cover plate 102 is shown as being a single piece in the illustrated example, the cover plate 102 can be formed from multiple pieces that at least partially enclose a corresponding one of the end gaps 95.

Figure 4:
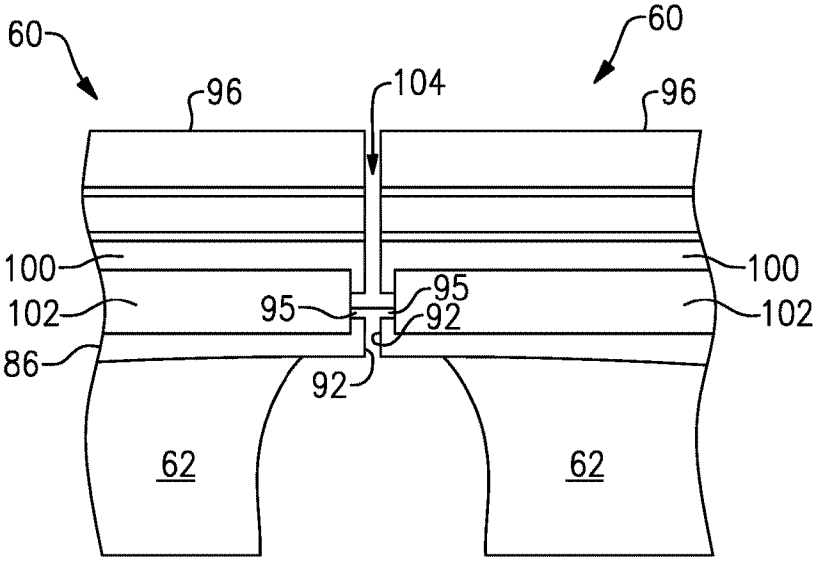
FIG. 4 illustrates a pair of adjacent outer platforms with a feather seal.

As shown in FIG. 4, the feather seal 104 is in engagement with adjacent vanes 60. The cover plates 102 on each of the vanes 60 are adjacent to the circumferential side surfaces 92 of each of the vanes 60. This decreases the amount of air loss traveling through the feather seal slot 94 through the axially aft surface 100. Additionally, by using a cover plate 102 instead of welding the end gap 95 shut, there is less of a chance that the vane 60 will be damaged while welding the end gaps 95 as opposed to welding the cover plate 102 onto the axially aft surface 100. This results in a decreased number of vane 60 that do not meet manufacturing tolerances due to damage resulting from welding one of the end gaps 95.

Figure 5:
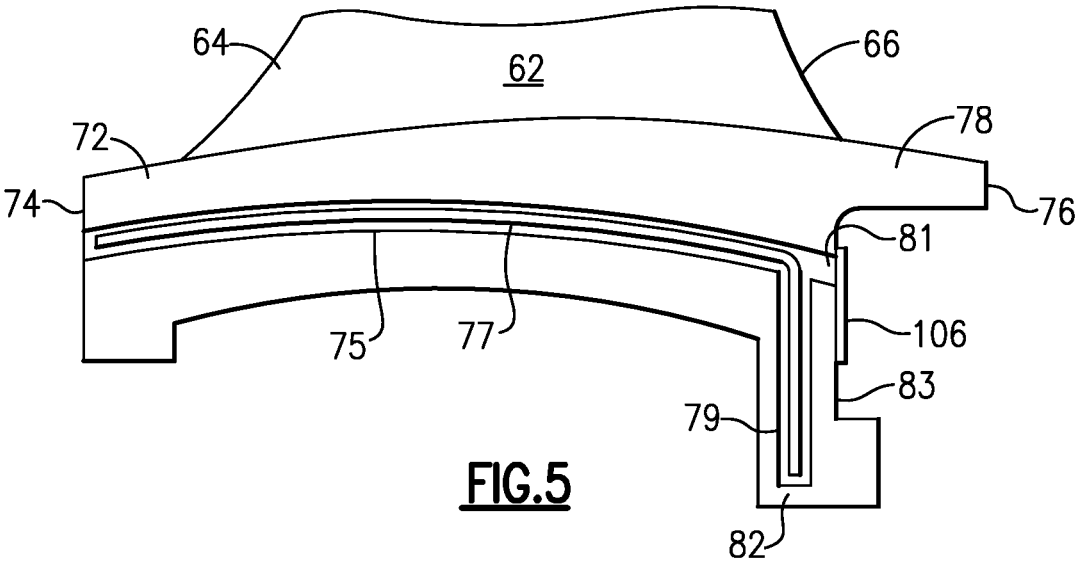
FIG. 5 is an enlarged view of an inner platform with a cover plate.

As shown in FIGS. 2 and 5, the radially inner platform 72 includes the axially extending feather seal slot 75 in each circumferential side surface 78. In the illustrated example, the feather seal slot 75 is formed through a grinding process. The grinding process used to form the feather seal slot 75 produces a smoother surface finish which increases contact area with a feather seal 77 (FIG. 5) to reduce air loss between adjacent vanes 60 as described above with respect to the feather seal slot 94. Additionally, the leading edge 74 of the inner platform 72 also includes an opening corresponding to the feather seal slot 75 in each of the opposing circumferential side surfaces 92. Additionally, because a grinding process is used to form the feather seal slot 75, an end gap 81 is formed in an axially aft surface 83 of the inner platform 72.

The inner rail 82 also includes an inner rail feather seal slot 79 that extends in a radial direction. The inner rail feather seal slot 79 is formed from an EDM process. Therefore, a surface roughness of the feather seal slot 79 has a different surface roughness than the outer rail feather seal slot 75 similar to the outer rail feather seal slot 98 described above.

Figure 6:
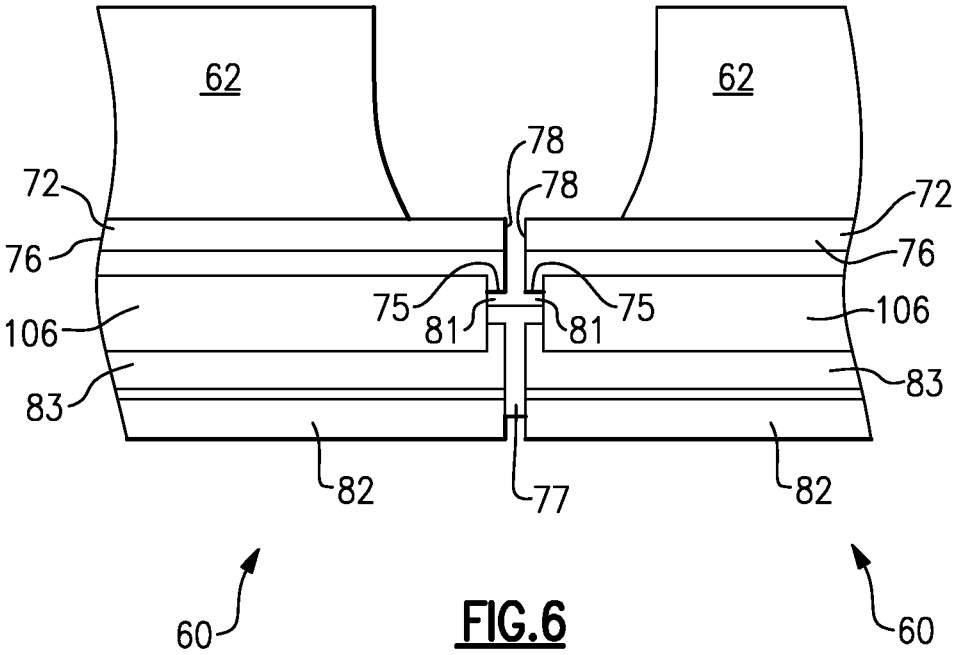
FIG. 6 illustrates a pair of adjacent inner platforms with a feather seal.

As shown in FIG. 6, the end gaps 81 are at least partially enclosed by a cover plate 106. In the illustrated example, the cover plate 106 extends a substantial width of the axially aft surface 83 and is attached to the axially aft surface 83 by a laser welding process. In the illustrated example, the cover plate 106 extends to adjacent the circumferential side surfaces 78. Although the cover plate 106 is shown as being a single piece in the illustrated example, the cover plate 106 can be formed from multiple pieces that at least partially enclose a corresponding one of the end gaps 81.

Figure 7:
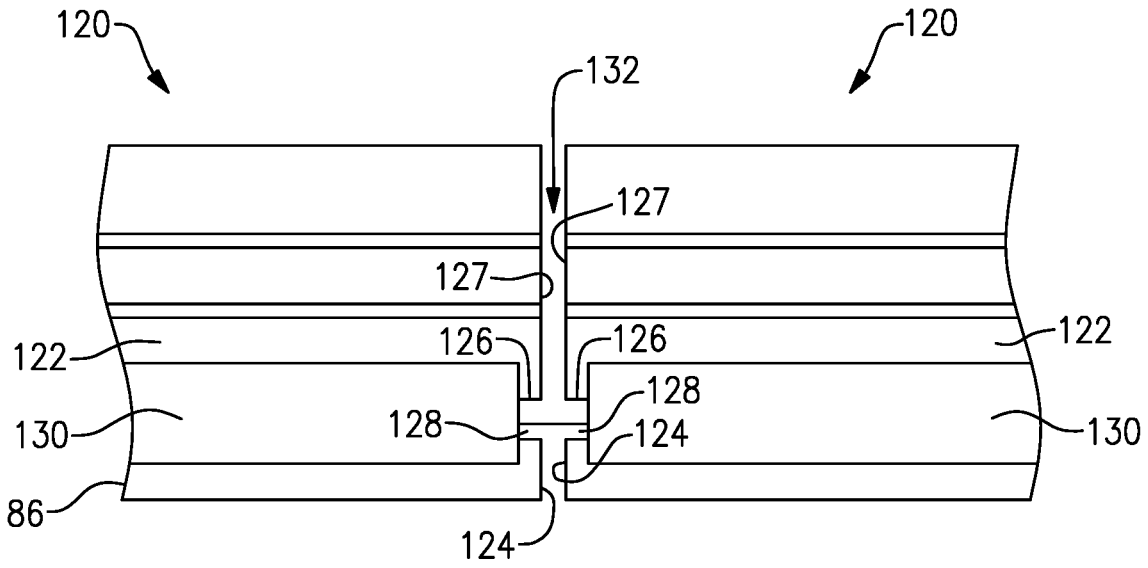
FIG. 7 illustrates an example blade outer air seal.

FIG. 7 schematically illustrates the disclosure directed to a blade outer air seal 120. The blade outer air seal 120 includes a trailing edge surface 122 that extend between opposite circumferential side surfaces 124. The blade outer air seal 120 also includes an axially extending feather seal slot 126 in each of the circumferential side surfaces 92 and a radially extending feather seal slot 127 for accepting a feather seal 132. In the illustrated example, the feather seal slot 126 is formed through a grinding process similar to the axially extending feather seal slots described above. The feather seal slot 126 also forms an end gap 128 in the trailing edge surface 122. A cover plate 130 is secured to the trailing edge surface 122 and at least partially encloses the end cap 128. The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A component for a gas turbine engine comprising:

a first platform having a first pair of circumferential surfaces that are circumferentially opposing, a first axially aft surface, and a surface defining a core gas flow path;

a first axially extending seal slot located in each of the first pair of circumferential surfaces and the first axially aft surface; and a first cover plate attached to the first axially aft surface enclosing at least a portion of the first axially extending seal slot located in each of the first pair of circumferential surfaces, wherein a radial direction and a circumferential direction are defined with respect to a central longitudinal axis of the gas turbine engine.

2. The component of claim 1, wherein the first axially aft surface intersects the pair of circumferential surfaces.

3. The component of claim 1, wherein the first axially extending seal slots are formed with a grinding process.

4. The component of claim 1, wherein the first cover plate is welded to the first axially aft surface.

5. The component of claim 4, wherein the first axially extending seal slots extend through a leading edge of the first platform.

6. The component of claim 1, wherein a portion of the first axially aft surface defines a trailing edge rail and the axially aft surface intersects the pair of circumferential surfaces and the component includes one of a blade outer air seal or an airfoil.

7. The component of claim 6, wherein the component is an airfoil and includes a first airfoil end adjacent the first platform and a second airfoil end adjacent a second platform having a second pair of circumferential surfaces and a second axially aft surface and a second axially extending seal slot located in each of the second pair of circumferential surfaces and the second axially aft surface.

8. The component of claim 7, including a second cover plate attached to the second axially aft surface enclosing at least a portion of the second axially extending seal slots.

9. A gas turbine engine comprising:

a compressor section upstream of a combustor section; and a turbine section downstream of the combustor section wherein at least one of the compressor section or the turbine section includes a component having:

a first platform having a first pair of circumferential surfaces that are circumferentially opposing and a first axially aft surface;

a first axially extending seal slot located in each of the first pair of circumferential surfaces and the first axially aft surface; and a first cover plate attached to the first axially aft surface enclosing at least a portion of the first axially extending seal slot located in each of the first pair of circumferential surfaces;

an airfoil having a first end adjacent the first platform and a second end adjacent a second platform, the second platform having a second pair of opposing circumferential surfaces and a second axially aft surface and a second axially extending seal slot located in each of the second pair of circumferential surfaces and the second axially aft surface, wherein a radial direction and a circumferential direction are defined with respect to a central longitudinal axis of the gas turbine engine.

10. The gas turbine engine of claim 9, wherein the first axially aft surface intersects the pair of circumferential surfaces.

11. The gas turbine engine of claim 9, wherein the first axially extending seal slots are formed with a grinding process.

12. The gas turbine engine of claim 9, wherein the first cover plate is welded to the first axially aft surface.

13. The gas turbine engine of claim 12, wherein the first axially extending seal slot extends through a leading edge of the first platform.

14. The gas turbine engine of claim 9, including a second cover plate attached to the second axially aft surface enclosing at least a portion of the second axially extending seal slots.

15. A method of forming a seal slot in a component including the steps of:

forming a first axially extending seal slot through each of a pair of first circumferential surfaces and through a first axially aft surface on a first platform, wherein the pair of first circumferential surfaces are circumferentially opposed, the first platform includes a surface defining a core flow path, and a circumferential direction is defined with respect to a central longitudinal axis of a gas turbine engine; and enclosing a portion of the first axially extending seal slot located in each of the pair of first circumferential surfaces with a cover plate attached to the first axially aft surface.

16. The method of claim 15, wherein the first axially extending seal slot located in each of the pair of first circumferential surfaces is formed through a grinding process.

17. The method of claim 15, further comprising the steps of:

forming a second axially extending seal slot through each of a pair of second circumferential surfaces and a second axially aft surface on a second platform, wherein the pair of second circumferential surfaces are circumferentially opposed, an airfoil includes a first end adjacent the first platform and a second end adjacent the second platform; and enclosing at least a portion of the pair of second axially extending seal slot, with a second cover plate attached to the second axially aft surface.

18. The method of claim 17, wherein the second axially extending seal slot is formed through a grinding process.

19. The method of claim 18, including welding the second cover plate to the first axially aft surface.

* * * * *